United States Patent [19]

Lagodka et al.

[11] 4,217,067

[45] Aug. 12, 1980

[54] MINE ROOF SUPPORT ASSEMBLY

[75] Inventors: Gunter Lagodka, Lunen; Harry Rosenberg, Ludinghausen; Kunibert Becker, Werl; Gerd Dunkel, Lunen, all of Fed. Rep. of Germany

[73] Assignee: Gewerkschaft Eisenhutte Westfalia, Lunen, Fed. Rep. of Germany

[21] Appl. No.: 12,018

[22] Filed: Feb. 14, 1979

[30] Foreign Application Priority Data

Feb. 18, 1978 [DE] Fed. Rep. of Germany ..... 2806982

[51] Int. Cl.[2] ..... E21D 15/44; E21D 19/02; E21D 23/04

[52] U.S. Cl. ..... 405/296; 299/33; 405/293; 405/299

[58] Field of Search ..... 405/296, 293, 294, 291, 405/299, 298, 300; 299/31-33

[56] References Cited

U.S. PATENT DOCUMENTS

| | | | |
|---|---|---|---|
| 2,716,025 | 8/1955 | Malloy et al. | 299/33 X |
| 4,010,618 | 3/1977 | Walker et al. | 405/296 X |
| 4,064,701 | 12/1977 | Friedrichs | 405/296 |
| 4,065,931 | 1/1978 | Neu et al. | 405/296 X |
| 4,073,149 | 2/1978 | Kauter | 405/296 |
| 4,089,181 | 5/1978 | Koppers | 405/296 |
| 4,127,303 | 11/1978 | Nakajima et al. | 299/31 X |

*Primary Examiner*—Stephen J. Novosad
*Attorney, Agent, or Firm*—Thompson, Birch, Gauthier & Samuels

[57] ABSTRACT

The invention relates to a mine roof support assembly for use in winning mineral material from a mineral mining working having a mineral face. The assembly comprises three roof support units positioned side-by-side along the face, and a goaf shield common to the three units. Each of the roof support units has a roof shield supported on a floor sill. The goaf shield is adjustable in height so as to extend from the floor to the roof of the working. Advance means are provided for advancing the roof support units towards the face, and further advance means are provided for advancing the goaf shield to follow up the advance of the roof support units. The further advance means acts between the goaf shield and the roof support units, and is such as to advance the goaf shield by a distance greater than the distance through which the advance means advances the roof support units.

18 Claims, 3 Drawing Figures

MINE ROOF SUPPORT ASSEMBLY

BACKGROUND TO THE INVENTION

This invention relates to a mine roof support assembly, and in particular to a mine roof support assembly for use in inclined mine workings.

It is known to provide a mine roof support assembly with a goaf shield or screen which seals off the goaf of the working from the protected area within the assembly in which personnel work. As a mine face progresses the goaf is filled up pneumatically with filling material (such as rock and rubble) and the goaf shield advanced to follow up the advance of the face and the mine roof support assembly. DT-Gbm, for example, discloses a mine roof support assembly comprising a plurality of roof support units positioned side-by-side along the face, and provided with a multi-part goaf screen made up of U-shaped elements which can be retracted and extended telescopically to suit varying depths of seam. Roof support units are also known having goaf shields of varying height.

Known mine roof support assemblies suffer from the disadvantage of drifting down the dip in inclined mine workings. Moreover, where a bonding agent has to be added to the filling material supplied to the goaf space, known assemblies either require the goaf shield to be advanced to follow up the advance of the face too soon to have allowed the filling material plus bonding agent to have set hard, or require the rate of winning of mineral material to be reduced to permit this setting to occur.

The object of the invention is to provide a mine roof support assembly which overcomes these disadvantages.

SUMMARY OF THE INVENTION

The present invention provides a mine roof support assembly for use in winning mineral material from a mineral mining working having a mineral face, the assembly comprising three roof support units positioned side-by-side along the face, and a goaf shield common to the three roof support units, each of the roof support units having a roof shield supported on a floor sill, the goaf shield being adjustable in height so as to extend from the floor to the roof of the working, advance means being provided for advancing the roof support units towards the face, and further advance means being provided for advancing the goaf shield to follow up the advance of the roof support units, the further advance means acting between the goaf shield and the roof support units and being such as to advance the goaf shield by a distance greater than the distance through which the advance means advances the roof support units.

In this arrangement, the roof support units are interconnected by means of the goaf shield. Thus, during advance, the roof support units are supported not only by the goaf shield, but also by one another. Consequently, the tendency of the units to drift down the incline is counteracted. Moreover, because the further advance means gives a larger advance step than the advance means, filling material and bonding agent supplied to the goaf space has longer to set as the goaf shield is advanced less frequently than with known assemblies.

Preferably, the further advance means is such as to advance the goaf shield by a distance which is twice the distance through which the advance means advances the roof support units. This means that the goaf shield is advanced after every two advances of the roof support unit, so that the setting time of the filling material and bonding agent is doubled.

Advantageously, both the advance means and the further advance means comprise hydraulic advance rams, the hydraulic advance rams of the further advance means having a working stroke at least twice that of the hydraulic advance rams of the advance means.

Preferably, the goaf shield is constituted by a goaf wall supported on three floor skids by means of three hydraulic props, each of the hydraulic props being mounted on a respective floor skid, and each floor skid being associated with a respective roof support unit, and wherein the goaf wall is adjustable in height to extend from the floor to the roof of the working. The goaf wall may be inclined with its base closer to the face than its top. This is particularly advantageous as the goaf wall can be inclined at the same angle as that defined by the filling material as it fills the goaf space. This prevents the danger of a sudden collapse of the face-side portion of the filling when the goaf shield is advanced.

Advantageously, each pair of adjacent floor skids is interconnected by a respective beam, each beam being pivotally connected to its two floor skids.

Preferably, the goaf wall is constituted by three pairs of goaf plates, each pair of goaf plates being associated with a respective roof support unit, and the two goaf plates of each pair being vertically slidable with respect to one another so as to adjust the height of the goaf wall. Each of said props may be associated with a respective pair of goaf plates, extension and retraction of said props causing the vertical adjustability of the goaf wall. Conveniently, the goaf plates associated with the middle roof support unit laterally overlap the goaf plates associated with each of the two outer roof support units.

Each of said props may support a respective roof cap which is telescopically guided in the roof shield of the associated roof support unit. Advantageously, each roof cap is provided with a respective double-acting hydraulic ram for advancing that roof cap towards the face and for assisting the further advance means in advancing the goaf shield to follow up the advance of the roof support units.

Preferably, the goaf shield and the roof support units are provided with mutually engaging guide members for guiding the advance movement of the goaf shield to follow the direction of advance of the roof support units. Conveniently, said mutually engaging guide members are provided one on the goaf-side end of the middle roof support unit and the other on the face-side end of the middle floor skid. Said other guide member may be provided with substantially vertical guide surfaces which converge in the direction of advance, and said one guide member may be provided with similarly conveying guide surfaces.

Advantageously, the further advance means comprise two hydraulic advance rams, each of which acts between a respective one of the two outer roof support units and the goaf shield, and each of which is inclined with respect to the direction of advance.

The two outer skids may be provided with supports for a duct for supplying filling material to the space behind the goaf wall.

Preferably, each roof support unit is provided with a "lemniscate" guide system between its floor sill and roof shield. Moreover, the roof shield of each roof support unit may be provided with an extension which can be extended towards the face by means of a hydraulic ram whose working stroke is the same as that of the hydraulic rams of the advance means.

BRIEF DESCRIPTION OF THE DRAWINGS

A mine roof support assembly constructed in accordance with the invention will now be described, by way of example, with reference to the accompanying drawings in which.

DESCRIPTION OF PREFERRED EMBODIMENT

Figure 1:
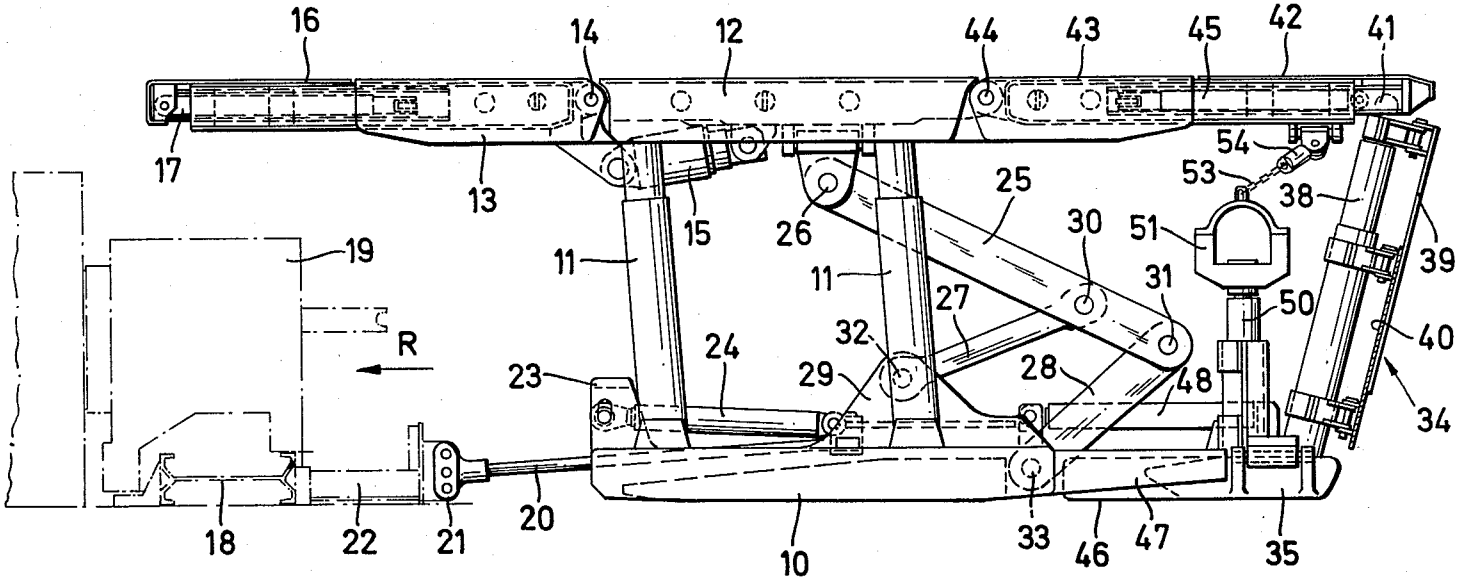
FIG. 1 is a side elevation of the roof support assembly.
Figure 2:
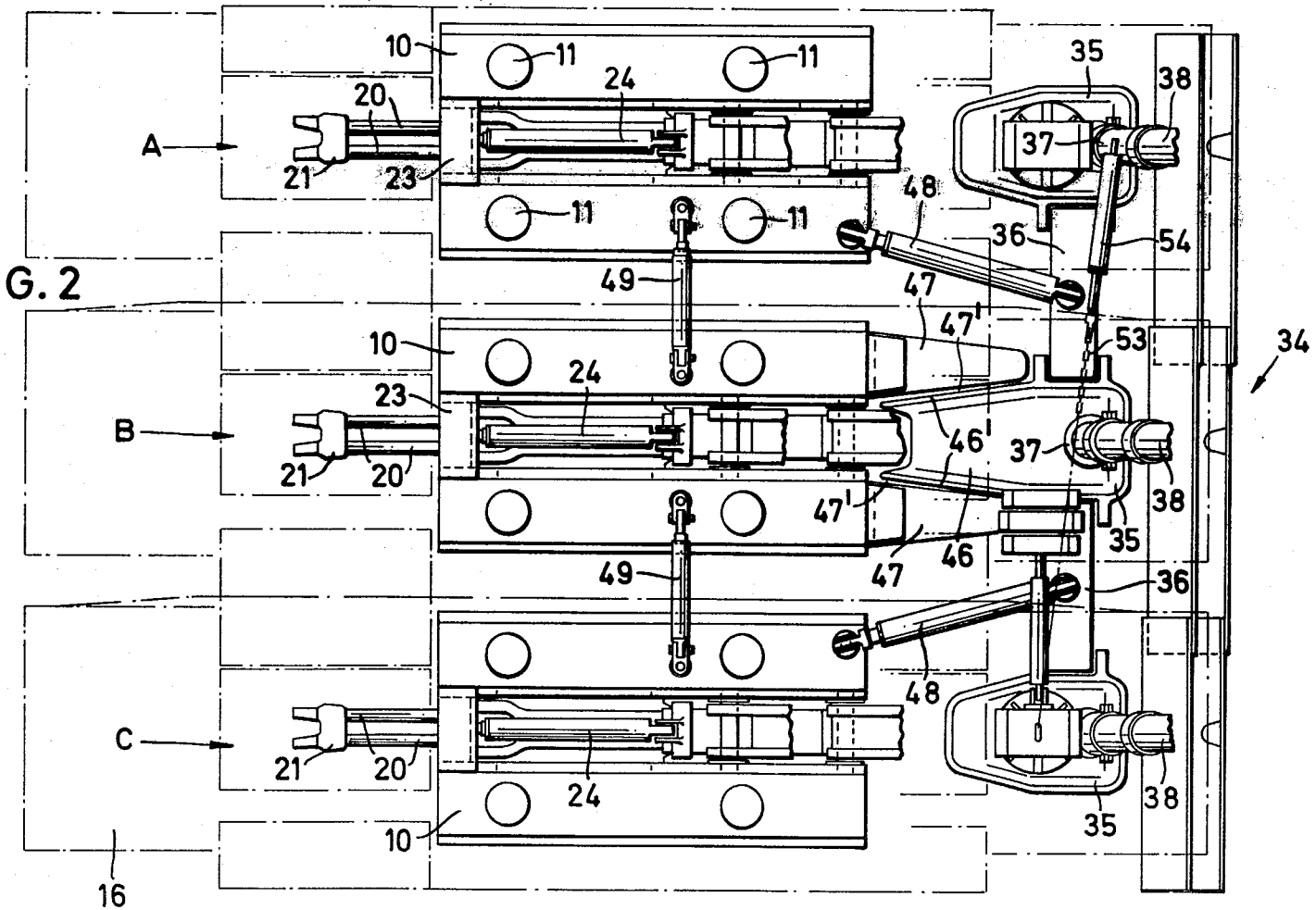
FIG. 2 is a plan view of the roof support assembly and shows the three roof support units of the assembly.

Referring to the drawings, FIG. 2 shows a mine roof support assembly comprising three basically similar roof support units A, B and C arranged side-by-side along a longwall working (not shown). Each roof support unit has a floor sill (constituted by a pair of spaced floor girders 10) which supports a roof shield 12 (see FIG. 1) by means of four hydraulic props 11. The four props 11 are arranged on pivot joints (not shown) positioned at the four corners of a rectangle. Similarly, the props 11 are connected to the roof shield 12 by means of pivot joints (not shown). Each roof shield 12 is provided with a front extension 13 which is pivotally connected, at 14, to the face side thereof. Each front extension can be pivoted, by means of a hydraulic ram 15, towards the roof of the working about a horizontal axis defined by the pivotal connection 14. Moreover, each front extension is provided with a further extension 16 which is slidably mounted therein, and which can be extended or retracted by means of a hydraulic ram 17.

A scraper-chain conveyor 18 is located on the face side of the roof support assembly, and a winning machine 19 is reciprocable along the face side of the conveyor to win mineral material (such as coal) from the face. The conveyor 18 also forms an abutment for the mine roof support assembly. For this purpose, each of the roof support units A, B and C is connected, by means of a respective guide-rod system 20 to the conveyor or (as shown) to a part 22 fixed to the conveyor. The face-side end of each guide-rod system 20 is connected to the part 22 by means of a respective headpiece 21, and its goaf-side end is slidably guided in slideways provided in the mutually facing side-edges of the floor girders 10 of that unit. Each guide-rod system 20 is completed by means of a hydraulic advance ram 24 which acts between the goaf-side end of that system and a bracket 23 fixed to the floor girders 10 at their face-side ends. Thus, when the rams 24 are retracted, the conveyor 18 is advanced in the direction of the arrow R (that is to say towards the face) and, when the rams 24 are extended, the roof support units A,B and C are advanced in a follow-up sequence.

Each of the roof support units A, B and C is fitted with the so-called "lemniscate" guide system. This system is fitted between the roof shield 12 and the floor girders 10 of each unit, and consists, in each case, of two sets of links positioned one at each side of that unit. Each set of links has a main link one end of which is pivotally connected to its roof shield 12 by means of a pivot joint 26, and two guide links 27 and 28. Each guide link 28 is pivotally connected at 32, to a bracket 29 fixed to the corresponding floor girder 10 and, at 30 to an intermediate portion of the corresponding main link 25. Similarly, each guide link 28 is pivotally connected, at 33, to the corresponding floor girder 10, and, at 31, to the other end of the corresponding main link 25. The "lemniscate" guide system ensures that, as the props 11 of a given unit A, B or C are retracted or extended, the roof shield 12 of that unit moves substantially vertically.

The three units A, B and C of the roof support assembly are provided with a common goaf shield 34. The goaf shield 34 is provided with floor-engaging supports constituted by three floor skids 35, each of which is associated with a respective unit A, B or C. Each adjacent pair of floor skids 35 is interconnected by means of a respective beam 36 pivotally connected to the two skids of that pair. Each floor skid 35 is provided with a respective pivot joint 37 which supports a respective hydraulic prop 38. Each prop 38 carries a pair of telescoped plates 39 and 40, the plates 39 and 40 overlapping the lateral adjacent plates to form a wall or shield at the goaf side of the assembly. The plates 39 and 40 are attached to their props 38 by means of clips (not shown). The plates 39 and 40 thus form a closed wall of adjustable height, and so the goaf shield 34 can be used in mine workings of variable height.

Each prop 38 is provided with a head pivot joint 41 of a respective roof cap 42. Each roof cap 42 is telescopically guided in a respective rear extension 43 pivotally connected, at 44, to the roof shield 12 of the corresponding roof support unit A, B or C. Each roof cap 42 is of box-like configuration and accommodates a respective hydraulic ram 45 which is used to move that roof cap into, and out of, the associated roof shield 12 and rear extension 43.

The floor skid 35 associated with the middle roof support unit B is provided with a forwardly-extending guide attachment 46, that is to say the guide attachment extends in the direction of the arrow R. The guide attachment 46 has lateral guide faces 46' which converge in the direction of the arrow R. The rear (goaf-side) ends of the floor girders 10 of the middle roof support unit B are each provided with a rearwardly-extending guide member 47. The guide members 47 have lateral guide faces 47' which converge in the direction of the arrow R. The guide faces 47' converge at the same angle as, and co-operate with, the guide faces 46' so that the guide attachment 46 is guided by the guide members 47 for movement to and fro in the direction of the arrow R. However, the guide faces 46' and 47' are such as to permit a limited degree of play so that the guide skid 35 associated with the unit B has a limited degree of pivotal movement in the plane parallel to that of the floor of the working.

Each of the two outer roof support units A and C is provided with a double-acting hydraulic ram 48 which acts between the inner floor girder 10 of that unit and the adjacent beam 36. As best seen in FIG. 2, each of these rams 48 is inclined to the direction of the arrow R. Thus, not only can the goaf shield 34 be advanced in the direction of the arrow R by the rams 48, but it can also be pivoted slightly in the plane parallel to that of the floor of the working. This enables the goaf shield 34 to be aligned accurately, or to be positioned at a small angle to the axis of the longwall working.

Each pair of adjacent units A, B and B,C is provided with a hydraulic alignment ram 49 for aligning the units relative to one another. As can be seen in FIG. 2, each of these rams extends perpendicular to the direction of the arrow R, and acts between the adjacent floor girders 10 of the two units in question.

Each of the floor skids 35 of the two outer units A and C is provided with an upstanding pedestal 50, these pedestals carrying a supply duct (shown in dash-dot lines 52 in FIG. 3) through which passes filling material for the spaces at the goaf side of the goaf shield 34. This filling material is transferred, in known manner, along the duct 52 pneumatically. The duct 52 is constituted by a plurality of duct sections joined end-to-end, and is mounted on the pedestals 50 by means of supports 51. Where the longwall working is inclined, the support 51 which is located down the incline (that is to say, the support associated with the unit C in the illustrated embodiment) is connected to a chain 53 which is connected to, and tensioned by, a hydraulic tensioning ram 54 attached to the roof cap of the unit (unit A in the illustrated embodiment) furthest up the incline. The chain 53 and ram 54 are used to align the duct 52 with openings (not shown) in the goaf shield plates 39 and 40.

Mineral is won from the face in such a manner that, during the uphill run of the winning machine 19, the roof support assembly is advanced, in the direction of the arrow R, relative to the goaf shield 34, by means of the advance rams 24, the conveyor 18 having previously been advanced. In practice, the conveyor 18 is constituted by a plurality of conveyor sections which correspond to the roof support units of a plurality of roof support assemblies positioned side-by-side along the conveyor. Thus, when the winning machine has moved past the conveyor sections associated with a given roof support assembly, those conveyor sections can be advanced, followed by the advance of the roof support units of that assembly. The rams 48 may be used to assist the advance movement of the roof support assembly. During advance of a given roof support assembly, its goaf shield 34 remains stationary with its props 38 extended. During the next downhill run of the winning machine 19, the further extensions 16 of the roof shields 12 are extended one by one immediately the winning machine has passed thereby, these further extensions being advanced by a distance equal to the cutting depths of the winning machine. The roof units can then be advanced again, by the advance rams 24, this advance occurring at the latest when the winning machine has reached the end of the downhill run. At the same time as any given roof support unit is advanced, its further extension 16 is retracted. So far, the roof support units have been advanced a distance twice that of the working stroke of the advance rams 24, and the goaf shield 34 has remained stationary. The goaf shield 34 is advanced, by means of the rams 45 and 48, in the direction of the arrow R by a distance equal to twice the working stroke of the advance rams 24. If, for example, the cutting depth of the winning machine 19 (and thus the working stroke of the advance rams 24) and the working stroke of the rams 15 associated with the further extension 16 is 700 millimeters, the working stroke of the rams 45 and 48 is such that the goaf shield 34 is advanced 1400 millimeters. After advance of the goaf shield 34, the space behind is immediately filled with pneumatically injected filling material, with the supply duct 52.

As can be seen in FIG. 1, the plates 39 and 40 of the goaf shield 34 are inclined so that their tops are closer to the goaf side of the working than their bases. In other words, the goaf shield 34 is inclined in the same direction as the natural slope adopted by the filling material as it fills up the goaf space. Preferably, the filling material includes a bonding agent, such as a quick-setting cement which binds the filling material together and so prevents flow thereof and collapse of the roof in this region. The slope of the goaf shield 34 also prevents collapse of the filled-in material when the goaf shield is next advanced.

Figure 3:
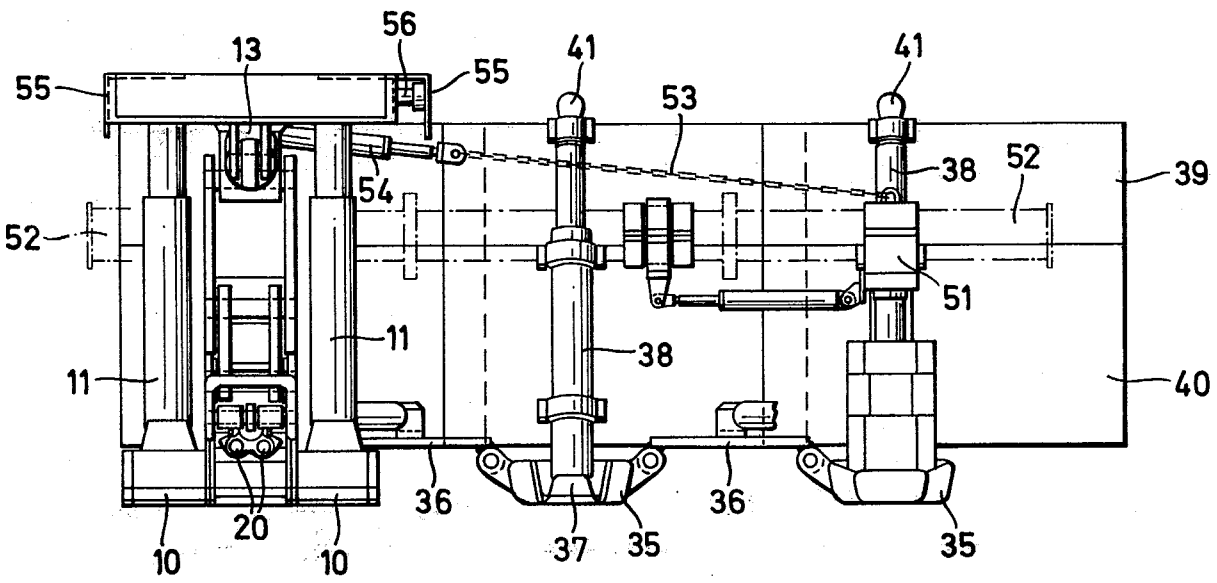
FIG. 3 shows the roof support assembly as seen from the face being won (the two units at the right-hand of the figure being shown with the face-side portions thereof missing).

The roof shield 12 of each roof support unit may be provided with lateral extensions 55 (see FIG. 3). These lateral extensions 55 are displaceable laterally outwards with respect to their roof shield 12, by means of hydraulic rams 56, to seal the gaps between adjacent roof shields, and so provide a complete covering for personnel in the working.

We claim:

1. A mine roof support assembly for use in winning mineral material from a mineral mining working having a mineral face, the assembly comprising three roof support units positioned side-by-side along the face, and a goaf shield common to the three roof support units, each of the roof support units having a roof shield supported on a floor sill, the goaf shield being adjustable in height so as to extend from the floor to the roof of the working, advance means being provided for advancing the roof support units towards the face, and further advance means being provided for advancing the goaf shield to follow up the advance of the roof support units, the further advance means acting between the goaf shield and the roof support units and being such as to advance the goaf shield by a distance greater than the distance through which the advance means advances the roof support units.

2. An assembly according to claim 1, wherein the further advance means is such as to advance the goaf shield by a distance which is twice the distance through which the advance means advances the roof support units.

3. An assembly according to claim 2, wherein both the advance means and the further advance means comprise hydraulic advance rams, the hydraulic advance rams of the further advance means having a working stroke at least twice that of the hydraulic advance rams of the advance means.

4. An assembly according to claim 3, wherein the further advance means comprise two hydraulic advance rams, each of which acts between a respective one of the two outer roof support units and the goaf shield, and each of which is inclined with respect to the direction of advance.

5. An assembly according to claim 3, wherein the roof shield of each roof support unit is provided with an extension which can be extended towards the face by means of a hydraulic ram whose working stroke is the same as that of the hydraulic rams of the advance means.

6. An assembly according to claim 1, wherein the goaf shield is constituted by a goaf wall supported on three floor skids by means of three hydraulic props, each of the hydraulic props being mounted on a respective floor skid, and each floor skid being associated with a respective roof support unit, and wherein the goaf wall is adjustable in height to extend from the floor to the roof of the working.

7. An assembly according to claim 6, wherein each pair of adjacent floor skids is interconnected by a respective beam, each beam being pivotally connected to its two floor skids.

8. An assembly according to claim 6, wherein the goaf wall is constituted by three pairs of goaf plates, each pair of goaf plates being associated with a respective roof support unit, and the two goaf plates of each pair being vertically slidable with respect to one another so as to adjust the height of the goaf wall.

9. An assembly according to claim 8, wherein each of said props is associated with a respective pair of goaf plates, extension and retraction of said props causing the vertical adjustability of the goaf wall.

10. An assembly according to claim 9, wherein each of said props supports a respective roof cap which is telescopically guided in the roof shield of the associated roof support unit.

11. An assembly according to claim 10, wherein each roof cap is provided with a respective double-acting hydraulic ram for advancing that roof cap towards the face and for assisting the further advance means in advancing the goaf shield to follow up the advance of the roof support units.

12. An assembly according to claim 8, wherein the goaf plates associated with the middle roof support unit laterally overlap the goaf plates associated with each of the two outer roof support units.

13. An assembly according to claim 6, wherein the goaf shield and the roof support units are provided with mutually engaging guide members for guiding the advance movement of the goaf shield to follow the direction of advance of the roof support units.

14. An assembly according to claim 13, wherein said mutually engaging guide members are provided one on the goaf-side end of the middle roof support unit and the other on the face-side end of the middle floor skid.

15. An assembly according to claim 14, wherein said other guide member is provided with substantially vertical guide surfaces which converge in the direction of advance, and wherein said one guide member is provided with similarly converging guide surfaces.

16. An assembly according to claim 6, wherein the goaf wall is inclined with its base closer to the face than its top.

17. An assembly according to claim 6, wherein the two outer floor skids are provided with supports for a duct for supplying filling material to the space behind the goaf wall.

18. An assembly according to claim 1, wherein each roof support unit is provided with a "lemniscate" guide system between its floor sill and roof shield.

* * * * *